US009201360B2

(12) United States Patent
Ito

(10) Patent No.: US 9,201,360 B2
(45) Date of Patent: Dec. 1, 2015

(54) IMAGE FORMING APPARATUS

(71) Applicant: KYOCERA Document Solutions Inc., Osaka-shi, Osaka (JP)

(72) Inventor: Shigeharu Ito, Osaka (JP)

(73) Assignee: KYOCERA Document Solutions Inc. (JP)

( * ) Notice: Subject to any disclaimer, the term of this patent is extended or adjusted under 35 U.S.C. 154(b) by 53 days.

(21) Appl. No.: 14/190,553

(22) Filed: Feb. 26, 2014

(65) Prior Publication Data

US 2014/0241747 A1 Aug. 28, 2014

(30) Foreign Application Priority Data

Feb. 27, 2013 (JP) ..... 2013-037555

(51) Int. Cl.
*G03G 15/20* (2006.01)

(52) U.S. Cl.
CPC ..... *G03G 15/2039* (2013.01); *G03G 15/205* (2013.01); *G03G 15/2046* (2013.01)

(58) Field of Classification Search
CPC ..... G03G 15/2046; G03G 15/2045; G03G 15/2039
USPC ..... 399/68, 69
See application file for complete search history.

(56) References Cited

FOREIGN PATENT DOCUMENTS

| | | | |
|---|---|---|---|
| JP | 5-158380 | | 6/1993 |
| JP | H06-253454 | | 9/1994 |
| JP | 7-72678 | | 3/1995 |
| JP | 2000-338823 | | 12/2000 |
| JP | 2002-132086 | | 5/2002 |
| JP | 2002-139954 | | 5/2002 |
| JP | 2004145086 | A * | 5/2004 |
| JP | 2006-301260 | | 11/2006 |
| JP | 2008-257270 | | 10/2008 |
| JP | 2013003553 | A * | 1/2013 |

OTHER PUBLICATIONS

Japanese Patent Appl. No. 2013-037555—Office Action issued Jun. 30, 2015.

* cited by examiner

*Primary Examiner* — Erika J Villaluna

(74) *Attorney, Agent, or Firm* — Gerald E. Hespos; Michael J. Porco; Matthew T. Hespos

(57) ABSTRACT

An image forming apparatus includes a printing portion, an ordinary printing controller, and an energy-saving printing controller. The ordinary printing controller causes the printing portion to perform ordinary printing at a first fixing temperature. The energy-saving printing controller causes the printing portion to perform energy-saving printing at a second fixing temperature lower than the first fixing temperature. The energy-saving printing controller selectively performs first energy-saving printing of performing the energy-saving printing by setting the sheet conveying speed to a first speed and setting the sheet interval to a first interval, and second energy-saving printing of performing the energy-saving printing by setting the sheet conveying speed to a second speed faster than the first speed and setting the sheet interval to a second interval larger than the first interval.

10 Claims, 5 Drawing Sheets

FIG. 3

| | ORDINARY PRINTING | ENERGY-SAVING PRINTING | |
|---|---|---|---|
| | | FIRST ENERGY-SAVING PRINTING | SECOND ENERGY-SAVING PRINTING |
| FIXING TEMPERATURE | T | T−50°C | T−50°C |
| CONVEYING SPEED | S | S/2 | S |
| SHEET INTERVAL | D | D | 2D |

IMAGE FORMING APPARATUS

This application is based on Japanese Patent Application No. 2013-37555 filed on Feb. 27, 2013, the contents of which are hereby incorporated by reference.

BACKGROUND

The present disclosure relates to an image forming apparatus capable of printing at a lowered fixing temperature.

Printing by an electrophotographic image forming apparatus includes a process of forming an electrostatic latent image of an image represented by image data, a process of forming a toner image by developing the electrostatic latent image, and a process of fixing the toner image on a sheet. The fixing process is performed by a fixing portion. The fixing portion is provided with a fixing roller, a pressing roller, and a heater. In the fixing portion, the fixing roller is heated by the heater, and a sheet carrying a toner image is allowed to pass a nip portion formed by the fixing roller and the pressing roller, whereby the toner image is fixed on the sheet.

Fixing electric power mainly occupies the electric power consumption of an image forming apparatus. Printing at a lowered fixing temperature contributes to remarkable reduction of electric power consumption of the image forming apparatus. In view of the above, there is proposed a technology of printing at a lowered fixing temperature.

The above technology is such that a time required for passing a sheet through a fixing portion is extended by lowering the printing speed to thereby avoid fixing failure regardless of a lowered fixing temperature. In the case where printing is performed at a lowered fixing temperature, the printing speed is lowered. It is preferable to reduce the lowering amount of the printing speed as much as possible.

An object of the present disclosure is to provide an image forming apparatus that enables to reduce a lowering amount of the printing speed as much as possible, in the case where printing is performed at a lowered fixing temperature.

SUMMARY

An image forming apparatus according to an aspect of the present disclosure includes a printing portion, an ordinary printing controller, and an energy-saving printing controller. The printing portion is configured to print an image, and includes an image forming portion configured to form a toner image representing an image to be printed on a sheet, a fixing portion configured to fix the toner image on the sheet by heating the sheet on which the toner image is formed at a predetermined fixing temperature, and a conveying portion including a sheet conveyance path, and configured to convey the sheet to the image forming portion and to the fixing portion at a predetermined conveying speed at a predetermined sheet interval, the sheet interval being an interval between a preceding sheet and a succeeding sheet conveyed one after another along the sheet conveyance path. The printing controller causes the printing portion to perform ordinary printing at a first fixing temperature. The energy-saving printing controller causes the printing portion to perform energy-saving printing at a second fixing temperature lower than the first fixing temperature. The energy-saving printing controller selectively performs first energy-saving printing of performing the energy-saving printing by setting the sheet conveying speed to a first speed and setting the sheet interval to a first interval, and second energy-saving printing of performing the energy-saving printing by setting the sheet conveying speed to a second speed faster than the first speed and setting the sheet interval to a second interval larger than the first interval.

These and other objects, features and advantages of the present disclosure will become more apparent upon reading the following detailed description along with the accompanying drawings.

BRIEF DESCRIPTION OF THE DRAWINGS

FIG. 3 is a table showing a comparison between ordinary printing and energy-saving printing;

DETAILED DESCRIPTION

Figure 1:
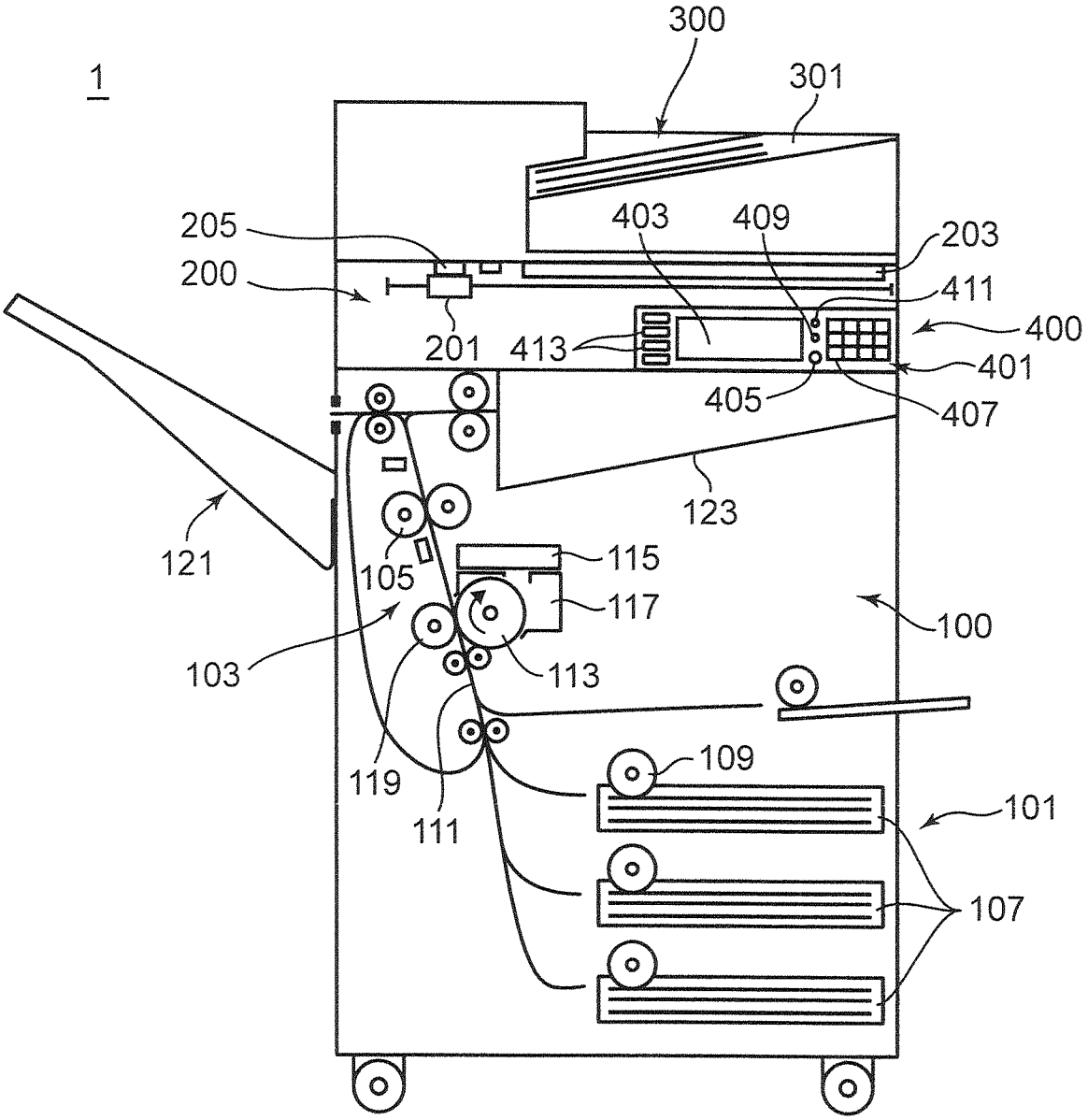
FIG. 1 is an explanatory diagram schematically showing an internal structure of an image forming apparatus embodying the present disclosure.

In the following, an embodiment of the present disclosure is described in detail referring to the drawings. FIG. 1 is an explanatory diagram schematically showing an internal structure of an image forming apparatus embodying the present disclosure. The image forming apparatus 1 is applicable to a digital complex machine having the functions of a copying machine, a printer, a scanner, and a facsimile machine. The image forming apparatus 1 is provided with an apparatus body 100, a document reading portion 200 disposed above the apparatus body 100, a document feeding portion 300 disposed above the document reading portion 200, and an operating portion 400 disposed on a front surface of an upper portion of the apparatus body 100.

The document feeding portion 300 functions as an automatic document feeder, and is configured to automatically feed documents placed on a document setting portion 301 so that the documents are sequentially read by the document reading portion 200.

The document reading portion 200 is provided with a carriage 201 on which an exposure lamp is loaded, a document platen 203 constituted of a transparent glass platen, an unillustrated CCD (Charge Coupled Device) sensor, and a document reading slit 205. In the case where a document placed on the document platen 203 is read, the document is read by the CCD sensor while moving the carriage 201 in the longitudinal direction of the document platen 203. On the other hand, in the case where a document fed from the document feeding portion 300 is read, the carriage 201 is moved to a position facing the document reading slit 205, and the document fed from the document feeding portion 300 is read by the CCD sensor through the document reading slit 205. The CCD sensor outputs the read document as image data.

The apparatus body 100 is provided with a sheet storing portion 101, an image forming portion 103, and a fixing portion 105. The sheet storing portion 101 is disposed at a lowermost portion of the apparatus body 100, and is provided with a sheet tray 107 configured to store a stack of sheets. An uppermost sheet of the sheet stack stored in the sheet tray 107 is fed toward a sheet conveying path 111 by driving a pickup roller 109. The sheet is conveyed to the image forming portion 103 along the sheet conveying path 111.

The image forming portion 103 forms a toner image on a conveyed sheet. The image forming portion 103 is provided with a photosensitive drum 113, an exposure portion 115, a developing portion 117, and a transfer portion 119. The exposure portion 115 generates light modulated in accordance with image data (image data outputted from the document reading portion 200, image data transmitted from a personal computer, image data transmitted from a facsimile machine, and the like), and irradiates light onto a uniformly charged circumferential surface of the photosensitive drum 113. By irradiation of the light, an electrostatic latent image corresponding to the image data is formed on the circumferential surface of the photosensitive drum 113. By supply of toner from the developing portion 117 to the circumferential surface of the photosensitive drum 113 in the above state, a toner image corresponding to the image data is formed on the circumferential surface of the photosensitive drum 113. The toner image is transferred to the sheet conveyed from the sheet storing portion 101 by the transfer portion 119.

The sheet carrying the transferred toner image is conveyed to the fixing portion 105. In the fixing portion 105, the toner image is fixed on the sheet by applying heat and a pressure to the toner image and to the sheet. Thereafter, the sheet is discharged onto a stack tray 121 or onto a discharge tray 123.

The operating portion 400 is provided with an operation key portion 401 and a display portion 403. The display portion 403 has a touch panel function, and is configured to display a screen including soft keys. The user is allowed to perform setting necessary for execution of the functions such as copying by operating the soft keys while viewing the screen.

The operation key portion 401 is provided with operation keys constituted of hard keys. Specifically, the operation key portion 401 is provided with a start key 405, a numeric keypad 407, a stop key 409, a reset key 411, function switching keys 413 for switching the functions between a copying machine, a printer, a scanner, and a facsimile machine.

The start key 405 is a key for allowing the user to start an operation of facsimile transmission and the like. The numeric keypad 407 is a key for allowing the user to input the numbers such as the number of copies to be printed, and the facsimile number. The stop key 409 is a key for allowing the user to stop a copying operation and the like. The reset key 411 is a key for allowing the user to return the set contents to an initialization state.

The function switching keys 413 include a copy key and a transmission key, and are keys for allowing the user to switch between the copying function, the transmission function, and the like. In the case where the copy key is operated, an initial screen of copying is displayed on the display portion 403. In the case where the transmission key is operated, an initial screen of facsimile transmission and e-mail transmission is displayed.

Figure 2:
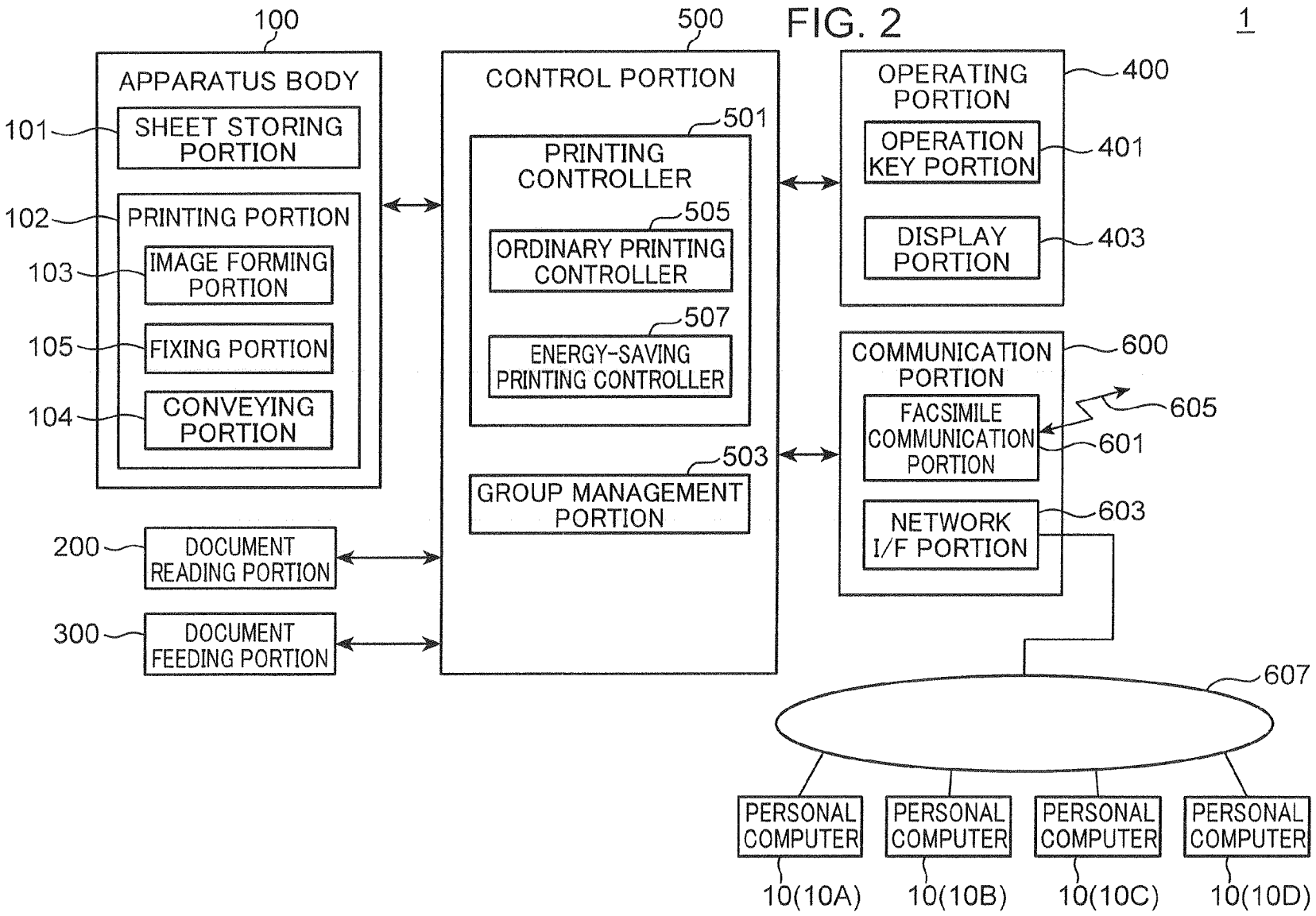
FIG. 2 is a block diagram showing a configuration of the image forming apparatus shown in FIG. 1.

FIG. 2 is a block diagram showing a configuration of the image forming apparatus 1 shown in FIG. 1. The image forming apparatus 1 is configured such that the apparatus body 100, the document reading portion 200, the document feeding portion 300, the operating portion 400, a control portion 500, and a communication portion 600 are connected with each other by a bus. Since the document reading portion 200, the document feeding portion 300, and the operating portion 400 have been described above, the repeated description thereof is omitted herein.

The apparatus body 100 includes a printing portion 102 configured to print an image. The printing portion 102 includes the image forming portion 103, the fixing portion 105, and a conveying portion 104. As described above, the image forming portion 103 forms a toner image representing an image to be printed on a sheet. As described above, the fixing portion 105 fixes the toner image on a sheet by heating the sheet carrying the toner image to a predetermined fixing temperature.

The conveying portion 104 is constituted of the sheet conveying path 111 (see FIG. 1) and sheet conveyor rollers disposed on the sheet conveying path 111. The conveying portion 104 conveys a sheet at a predetermined conveying speed to the image forming portion 103 and to the fixing portion 105 by setting a sheet interval between a preceding sheet and a succeeding sheet to be conveyed one after another along the sheet conveying path 111 to a predetermined interval.

The control portion 500 is provided with a CPU (Central Processing Unit), a ROM (Read Only Memory), a RAM (Random Access Memory), and an image memory. The CPU controls the respective constituent elements of the image forming apparatus 1 such as the apparatus body 100 to perform an operation necessary for operating the image forming apparatus 1. The ROM stores therein a software necessary for controlling the operation of the image forming apparatus 1. The RAM is used for temporarily storing data to be generated at the time of execution of a software, and for storing an application software. The image memory temporarily stores image data (image data outputted from the document reading portion 200, image data transmitted from a personal computer, image data transmitted from a facsimile machine, and the like).

The control portion 500 is provided with a printing controller 501 and a group management portion 503 as functional blocks. The details of the functional blocks will be described later.

The communication portion 600 is provided with a facsimile communication portion 601 and a network I/F portion 603. The facsimile communication portion 601 is provided with an NCU (Network Control Unit) configured to control connection with a telephone line to a recipient facsimile machine, and a modulation/demodulation circuit configured to modulate and demodulate a signal for facsimile communications. The facsimile communication portion 601 is connected with a telephone line 605.

The network I/F portion 603 is connected with a LAN (Local Area Network) 607. The network I/F portion 603 is a communication interface circuit configured to perform communications with a terminal device such as a personal computer, which is connected with the LAN 607. FIG. 2 shows personal computers 10A, 10B, 10C, and 10D connected with the LAN 607. In the case where it is not necessary to discriminate these personal computers one from the other, the personal computers are generically called as personal computers 10.

The printing controller 501 controls the printing portion 102 to perform printing. The printing controller 501 is provided with an ordinary printing controller 505 and an energy-saving printing controller 507.

FIG. 3 is a table showing a comparison between ordinary printing and energy-saving printing. The energy-saving printing is a printing to be performed at a fixing temperature lower than the fixing temperature in the ordinary printing. Assuming that the fixing temperature in the ordinary printing is T (° C.), the fixing temperature in the energy-saving printing is e.g. (T-50) (° C.). The ordinary printing controller 505 causes the printing portion 102 to perform the ordinary printing at a first fixing temperature T (° C.). The energy-saving printing controller 507 causes the printing portion 102 to perform the energy-saving printing at a second fixing temperature (T-50) (° C.), which is lower than the first fixing temperature.

The energy-saving printing includes first energy-saving printing and second energy-saving printing. The speed at which a sheet is conveyed by the conveying portion 104 is defined as a sheet conveying speed. Assuming that the sheet conveying speed in the ordinary printing is S, the sheet conveying speed in the first energy-saving printing is set to e.g. (S/2), and the sheet conveying speed in the second energy-saving printing is set to e.g. S.

In the ordinary printing, assuming that the interval (a sheet interval) at which sheets are conveyed one after another along the sheet conveying path 111 (see FIG. 1) is D, the sheet interval in the first energy-saving printing is set to e.g. D, and the sheet interval in the second energy-saving printing is set to e.g. 2D.

As described above, the first energy-saving printing is an energy-saving printing, in which the sheet conveying speed is set to the first speed (S/2), and the sheet interval is set to the first interval D. The second energy-saving printing is an energy-saving printing, in which the sheet conveying speed is set to the second speed S faster than the first speed (S/2), and the sheet interval is set to the second interval 2D larger than the first interval D.

Figure 4:
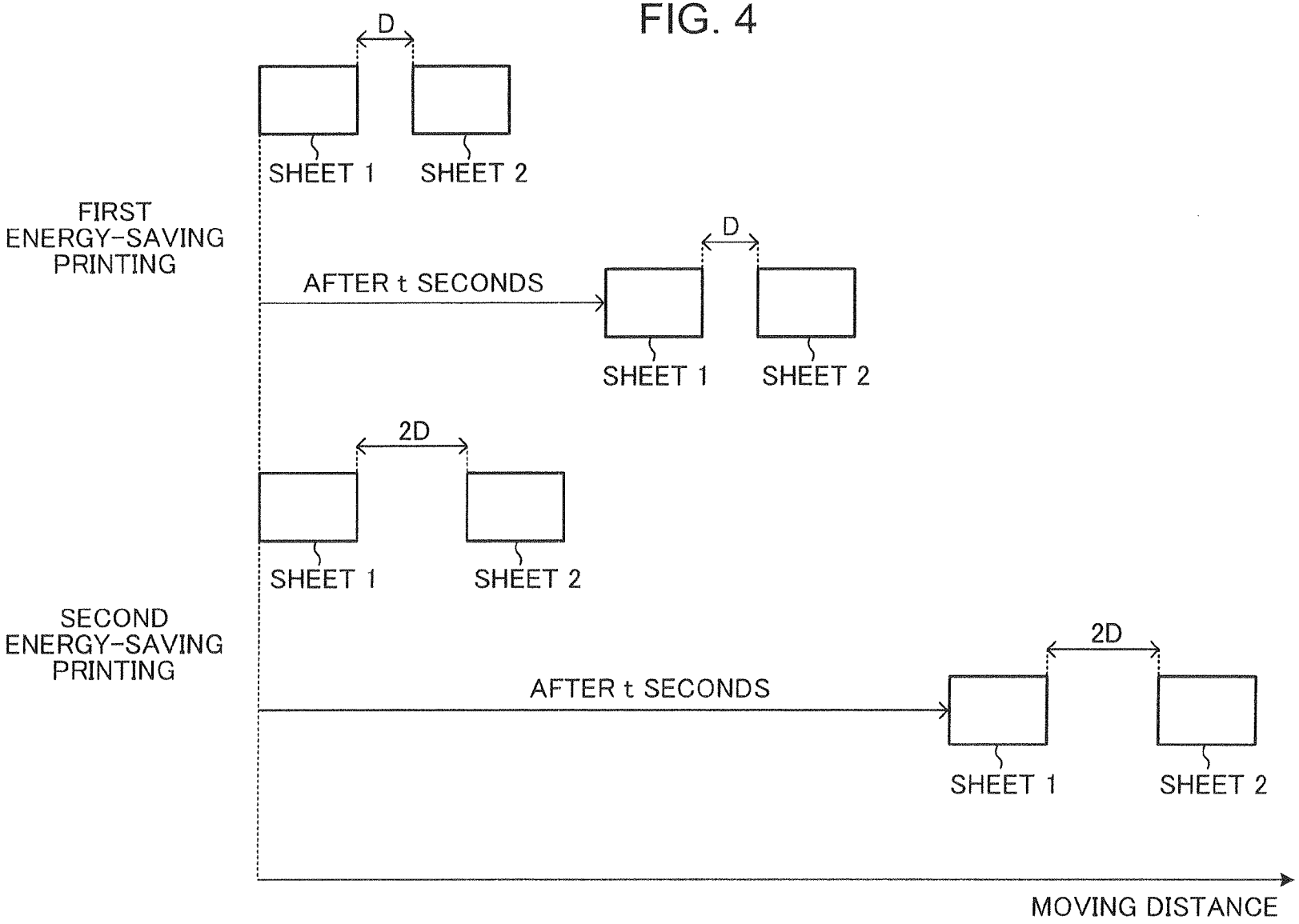
FIG. 4 is a comparison chart showing a comparison of printing speed between first energy-saving printing and second energy-saving printing.

The energy-saving printing controller 507 is operable to selectively perform the first energy-saving printing and the second energy-saving printing. The second energy-saving printing has a faster sheet conveying speed than in the first energy-saving printing. Accordingly, it is possible to make the printing speed faster. FIG. 4 is a comparison chart showing a comparison of printing speed between the first energy-saving printing and the second energy-saving printing.

FIG. 4 shows a state that a sheet 2 and a sheet 1 are conveyed in this order along the sheet conveying path 111. In the first energy-saving printing, the sheet interval between the sheet 2 and the sheet 1 is D, and in the second energy-saving printing, the sheet interval between the sheet 2 and the sheet 1 is 2D. The sheet conveying speed in the second energy-saving printing is twice as fast as the sheet conveying speed in the first energy-saving printing. Accordingly, the moving distance of the sheet 1, 2 after an elapse of t seconds is larger in the second energy-saving printing than in the first energy-saving printing. This means that the printing speed is faster in the second energy-saving printing than in the first energy-saving printing.

As compared with the case of the ordinary printing, the printing speed is slow in the second energy-saving printing. This is because as shown in FIG. 3, the sheet interval is larger in the second energy-saving printing than in the ordinary printing, although that the sheet conveying speed is the same between the second energy-saving printing and the ordinary printing.

The first energy-saving printing is more advantageous than the second energy-saving printing in the following points. In the case where energy-saving printing is performed, as far as the number of copies to be printed per printing job is small, it is possible to keep the temperature of the fixing roller in the fixing portion 105 to a temperature necessary for fixation, without lowering the sheet conveying speed. This makes it possible to avoid fixing failure. One printing job is a printing to be performed by the image forming apparatus 1 in response to a user operation of inputting a printing instruction to the image forming apparatus 1 one time. In the case where the image forming apparatus 1 is a copying machine, an operation of the start key 405 (see FIG. 1) is a printing instruction. In the case where the image forming apparatus is a printer, an operation of clicking a printing button with use of the personal computer 10 is a printing instruction.

In fixing a toner image on a sheet, the fixing roller in the fixing portion 105 is deprived of heat by the sheet. As a result, an increase in the number of copies to be printed per printing job may make it difficult to keep the temperature of the fixing roller in the fixing portion 105 to a temperature necessary for fixation, if the sheet conveying speed is fast in the energy-saving printing.

The sheet conveying speed in the first energy-saving printing is slower than in the second energy-saving printing. This makes it possible to extend a period of time of a fixing process (a period of time when a sheet is contacted with the fixing roller). Accordingly, even if the fixing temperature is lowered as compared with the ordinary printing, the first energy-saving printing is less likely to cause fixing failure, as compared with the second energy-saving printing, in the case where the number of copies to be printing is large.

Further, in the fixing process, as the fixing roller in the fixing portion 105 is rotated, heat is released from the fixing roller. An increase in the rotating speed of the fixing roller results in an increase in the heat release amount from the fixing roller, and heat loss (heat to be transferred to the parts other than a sheet) of the fixing roller increases. The sheet conveying speed in the first energy-saving printing is slower than in the second energy-saving printing. Accordingly, the rotating speed of the fixing roller in the first energy-saving printing is slower than in the second energy-saving printing. Thus, heat loss of the fixing roller is smaller in the first energy-saving printing than in the second energy-saving printing, and the energy-saving effect is larger in the first energy-saving printing than in the second energy-saving printing.

The space between a developing roller in the developing portion 117 (see FIG. 1) and the photosensitive drum 113 (see FIG. 1) is a high electrical field. As a period of time when the developing roller is rotated in an idle state is extended, damage of toner on the developing roller increases. The sheet interval in the first energy-saving printing is smaller than in the second energy-saving printing. Accordingly, a period of time when the developing roller is rotated in an idle state is shorter in the first energy-saving printing than in the second energy-saving printing. Thus, the first energy-saving printing is more advantageous in suppressing damage of toner on the developing roller.

As described above, the first energy-saving printing is more advantageous than the second energy-saving printing in the foregoing points.

The energy-saving printing controller 507 selects the first energy-saving printing in initialization of energy-saving printing, and selects the second energy-saving printing when the image forming apparatus 1 is in the energy-saving printing, in the case where a small-amount printing job has been sequentially generated a predetermined number of times.

The small-amount printing job is a job, in which the number of copies to be printed is not larger than a predetermined value (e.g. four in one-sided printing) in one-time printing job when the image forming apparatus 1 is in the energy-saving printing.

The energy-saving printing controller 507 switches the selection to the first energy-saving printing when the image forming apparatus 1 is in the energy-saving printing, in case where a non small-amount printing job has been sequentially generated a predetermined number of times, after the second energy-saving printing has been selected. The non small-amount printing job is a job, in which the number of copies to be printed is larger than a predetermined value (e.g. four in one-sided printing) in one-time printing job in the energy-saving printing.

The following is the reason why the first energy-saving printing is selected in initialization of energy-saving printing. As described above, in the case where the number of copies to be printed per printing job is large, fixing failure is less likely to occur in the first energy-saving printing, as compared with the second energy-saving printing. Further, as described above, the first energy-saving printing is more advantageous than the second energy-saving printing in the point of energy-saving effects. On the other hand, in the case where the number of copies to be printed is small (e.g. about two to four in one-sided printing) in one-time printing job, fixing failure is less likely to occur even in the second energy-saving printing.

It is unknown, in an early time of use of the image forming apparatus 1, whether a small-amount printing job is frequently performed or a non small-amount printing job is frequently performed. In initialization (in a default state) of the energy-saving printing controller 507, the first energy-saving printing is selected in the aspect of preventing fixing failure. Then, in the case where a small-amount printing job has been sequentially generated a predetermined number of times, the second energy-saving printing is selected when the image forming apparatus 1 is in the energy-saving printing, based on a judgment that a small-amount printing job is frequently performed in the image forming apparatus 1. This sets the printing speed to be large, as compared with the first energy-saving printing.

In the case where a non small-amount printing job has been sequentially generated a predetermined number of times, after the second energy-saving printing has been selected, the energy-saving printing is switched to the first energy-saving printing when the image forming apparatus 1 is in the energy-saving printing, based on a judgment that a non small-amount printing job is frequently performed in the image forming apparatus 1. This prevents fixing failure, even if the number of copies to be printed per printing job is large.

The second energy-saving printing may be selected when the image forming apparatus 1 is in the energy-saving printing, based on a judgment that a small-amount printing job is frequently performed in the image forming apparatus 1, in the case where the generation frequency of a small-amount printing job is larger than the generation frequency of a non small-amount printing job, in place of a case, in which a small-amount printing job has been sequentially generated a predetermined number of times. Then, the selection may be switched to the first energy-saving printing when the image forming apparatus 1 is in the energy-saving printing, based on a judgment that a non small-amount printing job is frequently performed in the image forming apparatus 1, in the case where the generation frequency of a non small-amount printing job is larger than the generation frequency of a small-amount printing job, in place of a case, in which a non small-amount printing job has been sequentially generated a predetermined number of times.

The group management portion 503 shown in FIG. 2 counts the number of small-amount printing jobs with respect to each of the groups to which each of the users using the image forming apparatus 1 belongs, in the case where the first energy-saving printing is selected by the energy-saving printing controller 507. For instance, regarding a user belonging to the group A, in the case where the number of small-amount printing jobs is "0", in response to an instruction of a small-amount printing job by the user belonging to the group A, the counted number of the small-amount printing jobs is "1". Then, in response to an instruction of a small-amount printing job by the user belonging to the group A, the counted number of the small-amount printing jobs is "2". Further, in response to an instruction of a small-amount printing job by the user belonging to the group A, the counted number of the small-amount printing jobs is "3". When a user belonging to the group A instructs a non small-amount printing job in this state, the counted number of the small-amount printing jobs is reset to "0". The energy-saving printing controller 507 determines whether a small-amount printing job has been sequentially generated a predetermined number of times in a state that the first energy-saving printing is selected in the group A, referring to the counted number.

Further, in the case where the second energy-saving printing is selected by the energy-saving printing controller 507, the group management portion 503 counts the number of non small-amount printing jobs with respect to each of the groups to which each of the users using the image forming apparatus 1 belongs. For instance, regarding a user belonging to the group A, in the case where the number of non small-amount printing jobs is "0", in response to an instruction of a non small-amount printing job by the user belonging to the group A, the counted number of the non small-amount printing jobs is "1". Then, in response to an instruction of a non small-amount printing job by the user belonging to the group A, the counted number of the non small-amount printing jobs is "2". Further, in response to an instruction of a non small-amount printing job by the user belonging to the group A, the counted number of the non small-amount printing jobs is "3". When a user belonging to the group A instructs a small-amount printing job in this state, the counted number of the non small-amount printing jobs is reset to "0". The energy-saving printing controller 507 determines whether a non small-amount printing job has been sequentially generated in a state that the second energy-saving printing is selected in the group A, referring to the counted number.

In this embodiment, determination as to whether a small-amount printing job has been sequentially generated a predetermined number of times in a state that the first energy-saving printing is selected is made with respect to each of the groups to which each of the users using the image forming apparatus 1 belongs. Likewise, determination as to whether a non small-amount printing job has been sequentially generated a predetermined number of times in a state that the second energy-saving printing is selected is made with respect to each of the groups to which each of the users using the image forming apparatus 1 belongs. Alternatively, the determinations may be made with respect to each of the users using the image forming apparatus 1, or with respect to each of the image forming apparatuses 1.

Figure 5:
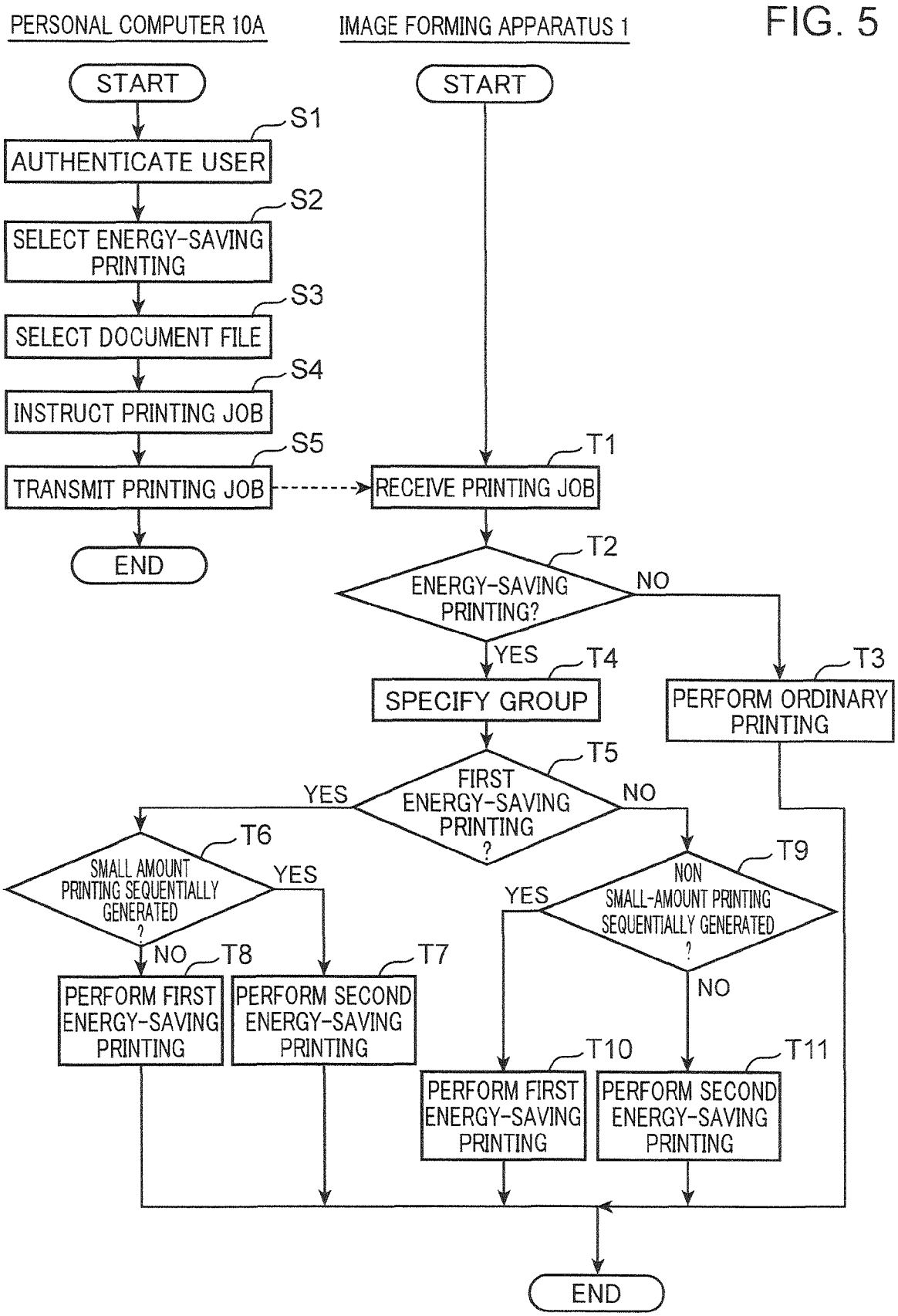
FIG. 5 is a flowchart showing an energy-saving printing operation to be performed by the image forming apparatus embodying the present disclosure.

An operation of the energy-saving printing to be performed by the image forming apparatus 1 according to the embodiment is described by an example, in which a document file stored in the personal computer 10A shown in FIG. 2 is printed. FIG. 5 is a flowchart for describing the operation.

User authentication utilizing e.g. password authentication is performed with use of the personal computer 10A (in Step S1). After the user authentication, the user of the personal computer 10A operates the personal computer 10A, and selects the energy-saving printing (in Step S2), and selects a document file to be printed with use of the image forming apparatus 1, out of the document files stored in the personal computer 10A (in Step S3).

Then, the user of the personal computer 10A operates the personal computer 10A, and instructs a printing job of the selected document file in the energy-saving printing (in Step S4).

The personal computer 10A transmits, to the image forming apparatus 1, an execution instruction of energy-saving printing, the document file selected by the user in Step S3, and additional data (such as the user name of the personal computer 10A which transmitted the document file) (in Step S5).

The network interface portion 603 (see FIG. 2) in the image forming apparatus 1 receives the execution instruction of energy-saving printing, the document file and the additional data, which have been transmitted from the personal computer 10A (in Step T1).

The printing controller 501 determines whether the printing job of the document file received in Step T1 is energy-saving printing (in Step T2).

In the case where the printing controller 501 determines that the printing job is not energy-saving printing (NO in Step T2), specifically, in the case where the printing controller 501 determines that the printing job is ordinary printing, the ordinary printing controller 505 perform the ordinary printing with respect to the document file received in Step T1 (in Step T3).

In the case where the printing controller 501 determines that the printing job is energy-saving printing (YES in Step T2), the group management portion 503 specifies the group to which the user authenticated in Step S1 belongs, out of the user names represented by the additional data received in Step T1 (in Step T4).

The energy-saving printing controller 507 determines whether setting of the energy-saving printing is the first energy-saving printing (in Step T5).

In the case where the energy-saving printing controller 507 determines that setting of the energy-saving printing is the first energy-saving printing (YES in Step T5), the energy-saving printing controller 507 determines whether a small-amount printing job has been sequentially generated a predetermined number of times in the group to which the user of the personal computer 10A belongs (in Step T6).

In the case where the energy-saving printing controller 507 determines that a small-amount printing job has been sequentially generated a predetermined number of times in the group to which the user of the personal computer 10A belongs (YES in Step T6), the energy-saving printing controller 507 switches the selection from the first energy-saving printing to the second energy-saving printing, and causes the printing portion 102 to perform the second energy-saving printing with respect to the document file received in Step T1 (in Step T7).

In the case where the energy-saving printing controller 507 determines that a small-amount printing job has not been sequentially generated a predetermined number of times in the group to which the user of the personal computer 10A belongs (NO in Step T6), the energy-saving printing controller 507 causes the printing portion 102 to perform the first energy-saving printing with respect to the document file received in Step T1 (in Step T8).

In the case where the energy-saving printing controller 507 determines that setting of the energy-saving printing is not the first energy-saving printing (NO in Step T5), in other words, in the case where the energy-saving printing controller 507 determines that setting of the energy-saving printing is the second energy-saving printing, the energy-saving printing controller 507 determines whether a non small-amount printing job has been sequentially generated a predetermined number of times in the group to which the user of the personal computer 10A belongs (in Step T9).

In the case where the energy-saving printing controller 507 determines that a non small-amount printing job has been sequentially generated a predetermined number of times in the group to which the user of the personal computer 10A belongs (YES in Step T9), the energy-saving printing controller 507 switches the selection from the second energy-saving printing to the first-energy saving printing, and causes the printing portion 102 to perform the first energy saving printing with respect to the document file received in Step T1 (in Step T10).

In the case where the energy-saving printing controller 507 determines that a non small-amount printing job has not been sequentially generated a predetermined number of times in the group to which the user of the personal computer 10A belongs (NO in Step T9), the energy-saving printing controller 507 causes the printing portion 102 to perform the second energy saving printing with respect to the document file received in Step T1 (in Step T11).

The following is the main advantages of the embodiment. As described referring to FIG. 3, in the embodiment, the printing speed is large in the second energy-saving printing, as compared with the first energy-saving printing by setting the conveying speed to be large. On the other hand, the sheet interval is large in the second energy-saving printing, as compared with the first energy-saving printing. Accordingly, it is possible to raise the temperature of the fixing portion 105, which has been lowered by fixing an image on a sheet, in a time from completion of an image fixation on a sheet to the next sheet carrying a toner image reaches the fixing portion 105. This is advantageous in preventing generation of fixing failure. According to the embodiment, since the second energy-saving printing can be selected, it is possible to reduce the lowering amount of the printing speed as much as possible, in the case where printing is performed at a lowered fixing temperature.

Further, according to the embodiment, as shown in FIG. 3, the conveying speed in the second energy-saving printing is set to be equal to the conveying speed in the ordinary printing. However, in order to prevent fixing failure, the sheet interval in the second energy-saving printing is set to be larger than the sheet interval in the ordinary printing. Accordingly, even if the fixing temperature in the second energy-saving printing is lower than the fixing temperature in the ordinary printing, it is possible to raise the temperature of the fixing portion 105 to a temperature necessary for fixing in a time from completion of an image fixation on a sheet to a next sheet carrying a toner image reaches the fixing portion 105, due to a large sheet interval.

Further, according to the embodiment, as shown in FIG. 3, the sheet interval in the second energy-saving printing is set to be larger than the sheet interval in the ordinary printing. Accordingly, even if the conveying speed in the second energy-saving printing is set to be equal to the conveying speed in the ordinary printing in a time from completion of an image fixation on a sheet to a next sheet carrying a toner image reaches the fixing portion 105, it is possible to raise the temperature of the fixing portion 105 to a temperature necessary for fixing. Thus, it is possible to prevent fixing failure, even if the conveying speed in the second energy-saving printing is set to be equal to the conveying speed in the ordinary printing.

The image forming apparatus 1 according to the embodiment is provided with the group management portion 503 (see FIG. 2). As described above, the group management portion 503 counts a consecutive number of small-amount printing jobs utilizing the first energy-saving printing, and counts a consecutive number of non small-amount printing jobs utilizing the first energy-saving printing, with respect to each of the groups to which each of the users using the image forming apparatus 1 belongs.

As described above, the energy-saving printing controller 507 selects the first energy-saving printing in initialization of the energy-saving printing. In the case where the user requesting a printing job belongs to the first group, in which a small-amount printing job utilizing the first energy-saving printing has been sequentially generated a predetermined number of times, when the image forming apparatus 1 is in the energy-saving printing, the energy-saving printing controller 507 switches the selection to the second energy-saving printing, and causes the printing portion 102 to perform a printing job (in Step T4, YES in Step T5, YES in Step S6, and in Step T7). Thus, in the case of a printing job of the user belonging to the first group, the second energy-saving printing is selected based on a judgment that small-amount printing jobs are frequently generated as the printing job of the user belonging to the first group. This is advantageous in increasing the printing speed.

On the other hand, there is a case that after the energy-saving printing controller 507 switches the selection to the second energy-saving printing with respect to the user belonging to the first group, non small-amount printing jobs utilizing the second energy-saving have been sequentially generated a predetermined number of times in the first group. In this case, in the case where the user requesting a printing job belongs to the first group, the energy-saving printing controller 507 switches the selection to the first energy-saving printing when the image forming apparatus 1 is in the energy-saving printing, and causes the printing portion 102 to perform a printing job (in Step T4, NO in Step T5, YES in Step T9, and in Step T10). Thus, in the case of a printing job of the user belonging to the first group, the first energy-saving printing is selected based on a judgment that non small-amount printing jobs are frequently generated as the printing job of the user belonging to the first group. This is advantageous in preventing fixing failure regardless of a large number of copies to be printed per printing job.

The following is the combination patterns of groups, generation frequencies of small-amount printing job, and generation frequencies of non small-amount printing job.

The group management portion 503 calculates a generation frequency of a small-amount printing job utilizing the first energy-saving printing, a generation frequency of a non small-amount printing job, a generation frequency of a small-amount printing job utilizing the second energy-saving printing, and a generation frequency of a non small-amount printing job, with respect to each of the groups to which each of the users of the image forming apparatus belongs.

In initialization of the energy-saving printing, in the case where the user requesting a printing job belongs to the second group, in which the generation frequency of a small-amount printing job utilizing the first energy-saving printing is larger than the generation frequency of a non small-amount printing job, when the image forming apparatus 1 is in the energy-saving printing, the energy-saving printing controller 507 selects the second energy-saving printing, and causes the printing portion 102 to perform a printing job. Thus, in the case of a printing job of the user belonging to the second group, the second energy-saving printing is selected based on a judgment that small-amount printing jobs are frequently generated as the printing job of the user belonging to the second group. This is advantageous in increasing the printing speed.

On the other hand, there is a case that after the energy-saving printing controller 507 switches the selection to the second energy-saving printing with respect to the user belonging to the second group, the generation frequency of a non small-amount printing job utilizing the second energy-saving printing is larger than the generation frequency of a small-amount printing job. In this case, in the case where the user requesting a printing job belongs to the second group, the energy-saving printing controller 507 switches the selection to the first energy-saving printing when the image forming apparatus 1 is in the energy-saving printing, and causes the printing portion 102 to perform a printing job. Thus, in the case of a printing job of the user belonging to the second group, the first energy-saving printing is selected based on a judgment that non small-amount printing jobs are frequently generated as the printing job of the user belonging to the second group. This is advantageous in preventing fixing failure regardless of a large number of copies to be printed per printing job.

A modification of the embodiment is described in the following. In the embodiment, the first energy-saving printing is selected in initialization of the energy-saving printing, and in the case where a small-amount printing job has been sequentially generated a predetermined number of times, the second energy-saving printing is selected when the image forming apparatus 1 is in the energy-saving printing (YES in T6, and in Step T7). In the modification, the energy-saving printing controller 507 includes a determination portion configured to determine whether the printing job instructed by the user is a non small-amount printing job or a small-amount printing job. In the case where the determination portion determines that the printing job is a non small-amount printing job, the energy-saving printing controller 507 causes the printing portion 102 to perform the first energy-saving printing, and in the case where the determination portion determines that the printing job is a small-amount printing job, the energy-saving printing controller 507 causes the printing portion 102 to perform the second energy-saving printing.

For instance, in the case where the user operates the personal computer 10, and instructs a printing job, the determination portion may determine that the printing job is a small-amount printing job, in the case where the number of copies to be printed by performing the printing job by the image forming apparatus 1 is not larger than four, and may determine that the printing job is a non small-amount printing, in the case where the number of copies to be printed is larger than four.

According to the modification, as far as one-time printing job instructed by the user is a small-amount printing job, it is possible to select the second energy-saving printing by prioritizing the printing speed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

a printing portion configured to print an image and including:

an image forming portion configured to form a toner image representing an image to be printed on a sheet;

a fixing portion configured to fix the toner image on the sheet by heating the sheet on which the toner image is formed at a predetermined fixing temperature; and a conveying portion including a sheet conveyance path, and configured to convey the sheet to the image forming portion and to the fixing portion at a predetermined conveying speed at a predetermined sheet interval, the sheet interval being an interval between a preceding sheet and a succeeding sheet conveyed one after another along the sheet conveyance path;

an ordinary printing controller configured to cause the printing portion to perform ordinary printing at a first temperature as the fixing temperature; and an energy-saving printing controller configured to cause the printing portion to perform energy-saving printing at a second temperature as the fixing temperature, the second temperature lower than the first temperature, wherein the energy-saving printing controller selectively performs a first energy-saving printing of performing the energy-saving printing by setting the conveying speed to a first speed and setting the sheet interval to a first interval, and a second energy-saving printing of performing the energy-saving printing by setting the conveying speed to a second speed faster than the first speed and setting the sheet interval to a second interval larger than the first interval, in one-time printing job in the energy-saving printing, assuming that a printing job in which the number of copies to be printed is larger than a predetermined value is a non small-amount printing job, and a printing job in which the number of copies to be printed is not larger than the predetermined value is a small-amount printing job, the energy-saving printing controller selects the first energy-saving printing in initialization of the energy-saving printing, and switches the selection to the second energy-saving printing when the image forming apparatus is in the energy-saving printing, in the case where the small-amount printing job has been sequentially generated a predetermined number of times.

2. The image forming apparatus according to claim 1, wherein the energy-saving printing controller switches the selection to the first energy-saving printing when the image forming apparatus is in the energy-saving printing, in the case where the non small-amount printing job has been sequentially generated a predetermined number of times after the second energy-saving printing has been selected.

3. The image forming apparatus according to claim 1, wherein the energy-saving printing controller controls the sheet interval in the second energy-saving printing to be larger than the sheet interval in the ordinary printing, and controls the conveying speed in the second energy-saving printing to be equal to the conveying speed in the ordinary printing.

4. An image forming apparatus, comprising:

a printing portion configured to print an image and including:

an image forming portion configured to form a toner image representing an image to be printed on a sheet;

a fixing portion configured to fix the toner image on the sheet by heating the sheet on which the toner image is formed at a predetermined fixing temperature; and a conveying portion including a sheet conveyance path, and configured to convey the sheet to the image forming portion and to the fixing portion at a predetermined conveying speed at a predetermined sheet interval, the sheet interval being an interval between a preceding sheet and a succeeding sheet conveyed one after another along the sheet conveyance path;

an ordinary printing controller configured to cause the printing portion to perform ordinary printing at a first temperature as the fixing temperature; and an energy-saving printing controller configured to cause the printing portion to perform energy-saving printing at a second temperature as the fixing temperature, the second temperature lower than the first temperature, wherein the energy-saving printing controller selectively performs a first energy-saving printing of performing the energy-saving printing by setting the conveying speed to a first speed and setting the sheet interval to a first interval, and a second energy-saving printing of performing the energy-saving printing by setting the conveying speed to a second speed faster than the first speed and setting the sheet interval to a second interval larger than the first interval, and in one-time printing job in the energy-saving printing, assuming that a printing job in which the number of copies to be printed is larger than a predetermined value is a non small-amount printing job, and a printing job in which the number of copies to be printed is not larger than the predetermined value is a small-amount printing job, the image forming apparatus further comprises:

a group management portion configured to count a consecutive number of small-amount printing jobs utilizing first energy-saving printing with respect to each of groups to which each of users using the image forming apparatus belongs, and the energy-saving printing controller selects the first energy-saving printing in initialization of the energy-saving printing, and switches the selection to the second energy-saving printing when the image forming apparatus is in the energy-saving printing, in the case where a user requesting the printing job belongs to a first group, the first group being a group, in which the consecutive number of small-amount printing jobs utilizing the first energy-saving printing has reached a predetermined number.

5. The image forming apparatus according to claim 4, wherein the group management portion counts the consecutive number of non small-amount printing jobs utilizing the second energy-saving printing with respect to each of the groups, and the energy-saving printing controller switches the selection to the first energy-saving printing when the image forming apparatus is in the energy-saving printing, if a user requesting the printing job belongs to the first group and in the case where the consecutive number of non small-amount printing jobs utilizing the second energy-saving printing has reached the predetermined number in the first group, after the selection is switched to the second energy-saving printing with respect to a user belonging to the first group.

6. An image forming apparatus, comprising:

a printing portion configured to print an image and including:

an image forming portion configured to form a toner image representing an image to be printed on a sheet;

a fixing portion configured to fix the toner image on the sheet by heating the sheet on which the toner image is formed at a predetermined fixing temperature; and a conveying portion including a sheet conveyance path, and configured to convey the sheet to the image forming portion and to the fixing portion at a predetermined conveying speed at a predetermined sheet interval, the sheet interval being an interval between a preceding sheet and a succeeding sheet conveyed one after another along the sheet conveyance path;

an ordinary printing controller configured to cause the printing portion to perform ordinary printing at a first temperature as the fixing temperature; and an energy-saving printing controller configured to cause the printing portion to perform energy-saving printing at a second temperature as the fixing temperature, the second temperature lower than the first temperature, wherein the energy-saving printing controller selectively performs a first energy-saving printing of performing the energy-saving printing by setting the conveying speed to a first speed and setting the sheet interval to a first interval, and a second energy-saving printing of performing the energy-saving printing by setting the conveying speed to a second speed faster than the first speed and setting the sheet interval to a second interval larger than the first interval, in one-time printing job in the energy-saving printing, assuming that a printing job in which the number of copies to be printed is larger than a predetermined value is a non small-amount printing job, and a printing job in which the number of copies to be printed is not larger than the predetermined value is a small-amount printing job, and the energy-saving printing controller selects the first energy-saving printing in initialization of the energy-saving printing, and switches the selection to the second energy-saving printing when the image forming apparatus is in the energy-saving printing, in the case where a generation frequency of the small-amount printing job is larger than a generation frequency of the non small-amount printing job.

7. The image forming apparatus according to claim 6, wherein the energy-saving printing controller switches the selection to the first energy-saving printing when the image forming apparatus is in the energy saving printing, in the case where the generation frequency of the non small-amount printing job is larger than the generation frequency of the small-amount printing job after the second energy-saving printing has been selected.

8. An image forming apparatus, comprising:

a printing portion configured to print an image and including:

an image forming portion configured to form a toner image representing an image to be printed on a sheet;

a fixing portion configured to fix the toner image on the sheet by heating the sheet on which the toner image is formed at a predetermined fixing temperature; and a conveying portion including a sheet conveyance path, and configured to convey the sheet to the image forming portion and to the fixing portion at a predetermined conveying speed at a predetermined sheet interval, the sheet interval being an interval between a preceding sheet and a succeeding sheet conveyed one after another along the sheet conveyance path;

an ordinary printing controller configured to cause the printing portion to perform ordinary printing at a first temperature as the fixing temperature; and an energy-saving printing controller configured to cause the printing portion to perform energy-saving printing at a second temperature as the fixing temperature, the second temperature lower than the first temperature, wherein the energy-saving printing controller selectively performs a first energy-saving printing of performing the energy-saving printing by setting the conveying speed to a first speed and setting the sheet interval to a first interval, and a second energy-saving printing of performing the energy-saving printing by setting the conveying speed to a second speed faster than the first speed and setting the sheet interval to a second interval larger than the first interval, in one-time printing job in the energy-saving printing, assuming that a printing job in which the number of copies to be printed is larger than a predetermined value is a non small-amount printing job, and a printing job in which the number of copies to be printed is not larger than the predetermined value is a small-amount printing job, the image forming apparatus further comprises:

a group management portion configured to calculate a generation frequency of the small-amount printing job and a generation frequency of the non small-amount printing job utilizing the first energy-saving printing with respect to each of groups to which each of users using the image forming apparatus belongs, and the energy-saving printing controller selects the first energy-saving printing in initialization of the energy-saving printing, and switches the selection to the second energy-saving printing when the image forming apparatus is in the energy-saving printing, in the case where a user requesting the printing job belongs to a second group, the second group being a group, in which a generation frequency of the small-amount printing job utilizing the first energy-saving printing is larger than a generation frequency of the non small-amount printing job utilizing the first energy-saving printing.

9. The image forming apparatus according to claim 8, wherein the group management portion calculates a generation frequency of the small-amount printing job and a generation frequency of the non small-amount printing job utilizing the second energy-saving printing with respect to each of the groups, and the energy-saving printing controller switches the selection to the first energy-saving printing when the image forming apparatus is in the energy-saving printing, if a user requesting the printing job belongs to the second group and in the case where a generation frequency of the non small-amount printing job utilizing the second energy-saving printing is larger than a generation frequency of the small-amount printing job utilizing the second energy-saving printing in the second group, after the selection is switched to the second energy-saving printing with respect to a user belonging to the second group.

10. An image forming apparatus, comprising:

a printing portion configured to print an image and including:

an image forming portion configured to form a toner image representing an image to be printed on a sheet;

a fixing portion configured to fix the toner image on the sheet by heating the sheet on which the toner image is formed at a predetermined fixing temperature; and a conveying portion including a sheet conveyance path, and configured to convey the sheet to the image forming portion and to the fixing portion at a predetermined conveying speed at a predetermined sheet interval, the sheet interval being an interval between a preceding sheet and a succeeding sheet conveyed one after another along the sheet conveyance path;

an ordinary printing controller configured to cause the printing portion to perform ordinary printing at a first temperature as the fixing temperature; and an energy-saving printing controller configured to cause the printing portion to perform energy-saving printing at a second temperature as the fixing temperature, the second temperature lower than the first temperature, wherein the energy-saving printing controller selectively performs a first energy-saving printing of performing the energy-saving printing by setting the conveying speed to a first speed and setting the sheet interval to a first interval, and a second energy-saving printing of performing the energy-saving printing by setting the conveying speed to a second speed faster than the first speed and setting the sheet interval to a second interval larger than the first interval, in one-time printing job in the energy-saving printing, assuming that a printing job in which the number of copies to be printed is larger than a predetermined value is a non small-amount printing job, and a printing job in which the number of copies to be printed is not larger than the predetermined value is a small-amount printing job, the energy-saving printing controller includes a determination portion configured to determine whether a printing job instructed by a user is the non small-amount printing job or the small-amount printing job, and the energy-saving printing controller causes the printing portion to perform the first energy-saving printing, in the case where the determination portion determines that the printing job is the non small-amount printing job, and causes the printing portion to perform the second energy-saving printing, in the case where the determination portion determines that the printing job is the small-amount printing job.

* * * * *